US005775239A

United States Patent [19]

Papajewski et al.

[11] Patent Number: 5,775,239

[45] Date of Patent: Jul. 7, 1998

[54] DOUBLE CAM DRIVES FOR A BUTTONHOLE SEWING MACHINE

[75] Inventors: Rudy Papajewski, deceased, late of Stutensee, by Edith A. Papajewski, legal representative; Gerd Papajewski, Stutensee, both of Germany; Louis Tocchio, Glen Allen, Va.

[73] Assignee: AMF Reece, Inc., Mechanicsville, Va.

[21] Appl. No.: 779,107

[22] Filed: Jan. 6, 1997

[51] Int. Cl.[6] ..... D05B 3/06

[52] U.S. Cl. ..... 112/65; 112/448

[58] Field of Search ..... 112/65, 157, 448, 112/443, 449, 459

[56] References Cited

U.S. PATENT DOCUMENTS

| | | | |
|---|---|---|---|
| 924,903 | 6/1909 | Hemleb . | |
| 3,522,781 | 8/1970 | Baruffa | 112/448 |
| 3,643,612 | 2/1972 | Hanyu et al. | 112/448 |
| 3,894,500 | 7/1975 | Hsiao . | |
| 4,183,309 | 1/1980 | Bajer et al. . | |
| 4,658,744 | 4/1987 | Takauchi et al. | 112/448 X |
| 5,179,904 | 1/1993 | Hoyano et al. . | |

*Primary Examiner*—Paul C. Lewis
*Attorney, Agent, or Firm*—James Creighton Wray

[57] ABSTRACT

A double cam drive operates on a main drive shaft of a buttonhole sewing machine is disclosed. Three double cams are arranged sequentially on the main drive shaft. A first double cam operates a looper mechanism, a second double cam drives a feeder, and a third double cam drives a needle bar mount for operating a bite mechanism to deflect a needle housing to make side stitches and tacks. Each double cam has a cam collar and two generally-circular concentric cams. Each cam of a double cam is positioned off-center on the cam collar with one cam positioned opposite the other. The three double cams have mounted collars at axial ends for securing the double cams to the shaft. Spacers are positioned between any two adjacent double cams for creating the proper spacing between the cams. A follower plate is pivoted on a stub shaft and has two rollers. The first roller contacts an outer surface of the first double cam and the second roller contacts an outside surface of the second double cam. The first roller is positioned directly opposite the second roller. The positioning of the cams on the cam collars and the positioning of the rollers allows the cams to remain in constant contact with a given drive mechanism.

33 Claims, 5 Drawing Sheets

DOUBLE CAM DRIVES FOR A BUTTONHOLE SEWING MACHINE

BACKGROUND OF THE INVENTION

The present invention relates to a sewing machine having double cam drives for producing buttonholes in workpieces. To form a buttonhole, a sewing machine bite stitches to form the straight sides while feeding the workpiece and barring stitches at ends of the buttonholes when the workpiece stops. Single treads are held beneath the workpiece by alternating loopers. Prior art sewing machines achieve results by using single cams rotating with the main drive shaft in rotary motion. The rotary motion is transformed by transmission elements in to translational motions. The translational motions move the sewing machine needles and workpieces to the appropriate positions in relation to each other. Typically, the prior art cams are shaped such that one revolution of the cam for 360 degrees corresponds to the complete translation. Because the cams operate at relatively high speeds, the transmission elements may lose contact with the cams. That may result in uneven needle and workpiece movements and consequently the uneven placement of stitches. As a result of uneven stitching, the buttonholes may not be completely symmetrical. Because the permissible deviations of the stitching is extraordinarily small, stitches that are placed too close to the center of the buttonhole will be severed by the cutting knife. Symmetrical buttonholes are necessary because a garment with a non-symmetrical buttonhole is considered defective. The problems of the transmission elements losing contact with the prior art cams is not eliminated by time consuming efforts and professional skills in mounting prior art cams on the main drive shaft. Furthermore, the precise shaping of the single cams, such that there are minimal deviations from a normal size, is not effective in eliminating the problems.

SUMMARY OF THE INVENTION

An objective of the present invention is to remedy the disadvantages of the prior art by providing an improved apparatus that allows users to form consistent and precise buttonholes in garments.

A strength of the present invention is that it provides for ensuring that cams on the main drive shafts of a buttonhole sewing machines remain in constant contact with drive mechanisms.

Double cam drives on buttonhole sewing machines operate from the main drive shafts. In a preferred embodiment, three double cams are arranged sequentially on the main drive shaft. A first double cam operates a looper mechanism, a second double cam drives a feeder, and a third double cam drives a needle bar mount for operating a bite mechanism to deflect a needle housing to make bite stitches. Spacers are positioned between the first and second cams in the double cams for creating the proper spacing between the cams.

In one embodiment, the cams are made of a plastic material and are molded in one piece. The double cams may be machined of steel and case hardened as a unit. Alternatively, the double cams may be pressed or welded on the bushing. Each double cam has a cam collar mounted on a bushing extension for securing the double cams to the shaft. The cams have a variety of shapes. Each cam of a double cam is positioned off-center on the cam bushing, with one cam positioned opposite the other. That allows the cams to remain in constant contact with follower mechanisms.

In a preferred embodiment, the three double cams are a looper cam, a feed cam, and a bite cam. The looper cam has two concentric cams respectively positioned at an end region and at a middle region of the looper cam bushing section. The feed cam has two elliptically shaped concentric cams respectively positioned at an end region and at a middle region of a feed cam bushing section. The bite cam has two concentric cams respectively positioned at an end region and at a middle region of a bite cam bushings.

A follower plate is pivoted on a stub shaft and has two rollers. The first roller contacts an outer surface of the first double cam, and the second roller contacts an outside surface of the second double cam. The first roller is positioned opposite the second roller. In one embodiment, each follower plate is flat, and the rollers extend from opposite sides of the plate. The bushing provides a space for the follower plate and roller mounts that extend through the follower plate for mounting the opposite rollers.

In preferred embodiments, each follower has two plates mounted on a stub pivot shaft. Each plate has one roller. Mounted springs allow minor relative movement between the plates and keep the rollers in contact with the double cams.

These and further and other objects and features of the invention are apparent in the disclosure, which includes the above and ongoing written specification, with the claims and drawings.

DETAILED DESCRIPTION OF THE DRAWINGS

Figure 1:
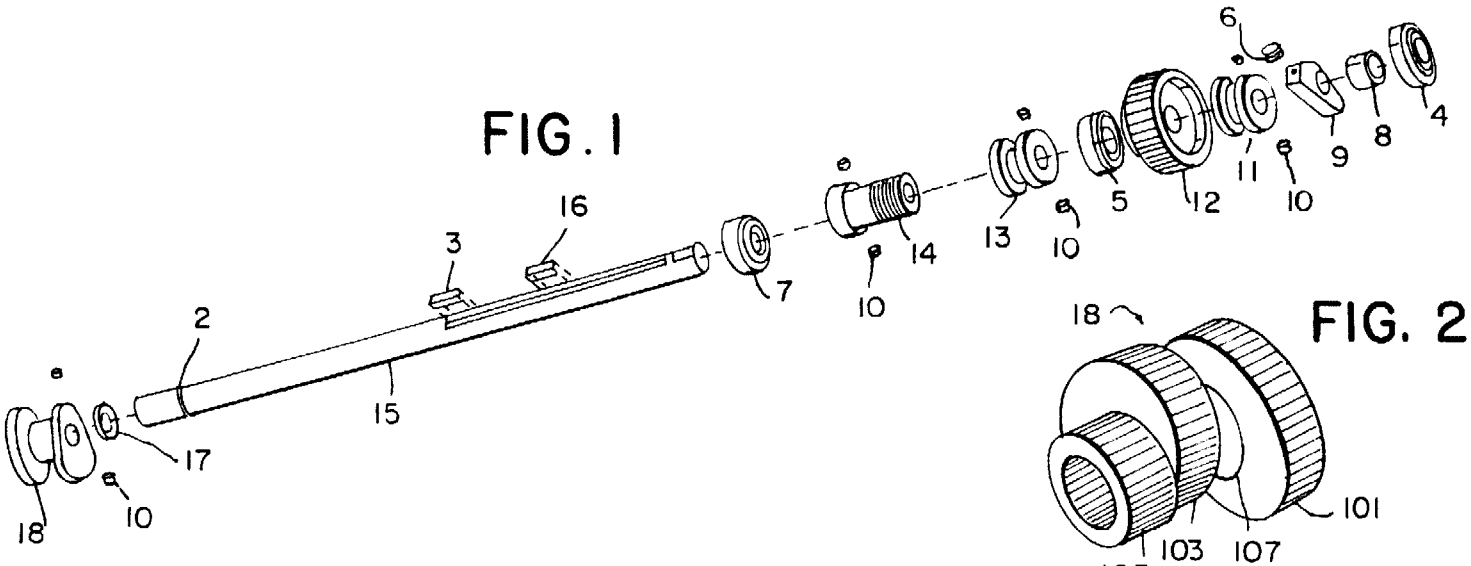
FIG. 1 shows a cross-sectional side view of the looper cam, the feed cam, and the bite cam mounted on the main drive shaft.

Referring to FIG. 1, a looper cam 18, a feed cam 13, and a bite cam 11 are positioned on the main drive shaft 15. The looper cam 18 is positioned on the shaft 15 spaced from the feed cam 13 and is separated from the feed cam 13 by a first bearing 7 and a worm gear 14. A snap ring 17 is positioned in a groove 2 on the main drive shaft 15. The feed cam 13 is positioned on the shaft 15 spaced from the bite cam 11 and is separated from the bite cam 11 by a second bearing 5 and a drive pulley 12. The drive pulley 12 is keyed to the main drive shaft 15 with a first key 3. Set screws 10 secure the looper cam, the feed cam and the bite cam 11 on the main drive shaft 15.

A stop cam 9 is positioned adjacent to the bite cam 11. The stop cam 9 is keyed to the main drive shaft 15 with a second key 16. A set screw 6 holds the stop cam 9 in place. A third bearing 4 is separated from the stop cam 9 by stop cam spacer 8. Three bearings 4, 5 and 7 mount the main drive shaft 15 in lugs depending from a bedplate.

Figure 2A:
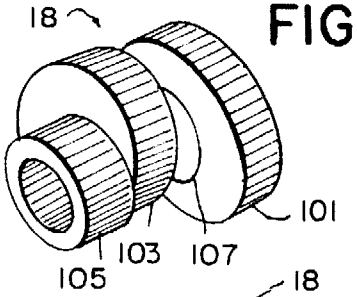
FIGS. 2A, 2B, and 2C are a perspective view, an end view and a cross-sectional side view, respectively of the looper cam having two concentric cams formed on a looper cam bushing.
Figure 2C:
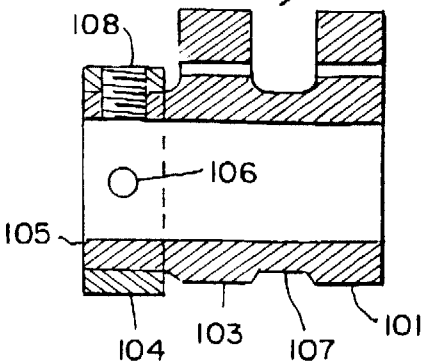
Figure 2B:
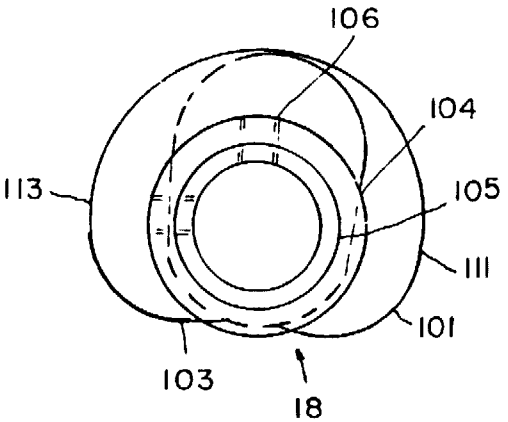

FIGS. 2A, 2B and 2C show a perspective view, an end view and a cross-sectional side view respectively of the looper double cam 18. The looper cam 18 has a first and a second concentric cam 101, 103. The first concentric cam 101 of the looper double cam 18 is formed at an end of the looper cam bushing 107. The second concentric cam 103 is formed at a middle of the looper cam bushing 107. Each concentric cam has a similar shape. As shown in FIG. 2B, both the first and the second concentric cams 101, 103 are eccentrically positioned on the looper cam bushing 107. The first concentric cam 101 is offset in such a manner that the maximum displacement of lobe 111 of the first concentric cam 101 is oriented opposite the maximum displacement of lobe 113 of the second concentric cam 103. As shown in FIGS. 2B and 2C, a collar 104 surrounds an extended portion 105 of the bushing 107. Threaded openings 106 in the collar 104 and bushing 107 receive set screws 108 to fix the looper double cam 18 on the drive shaft 15.

Figure 3:
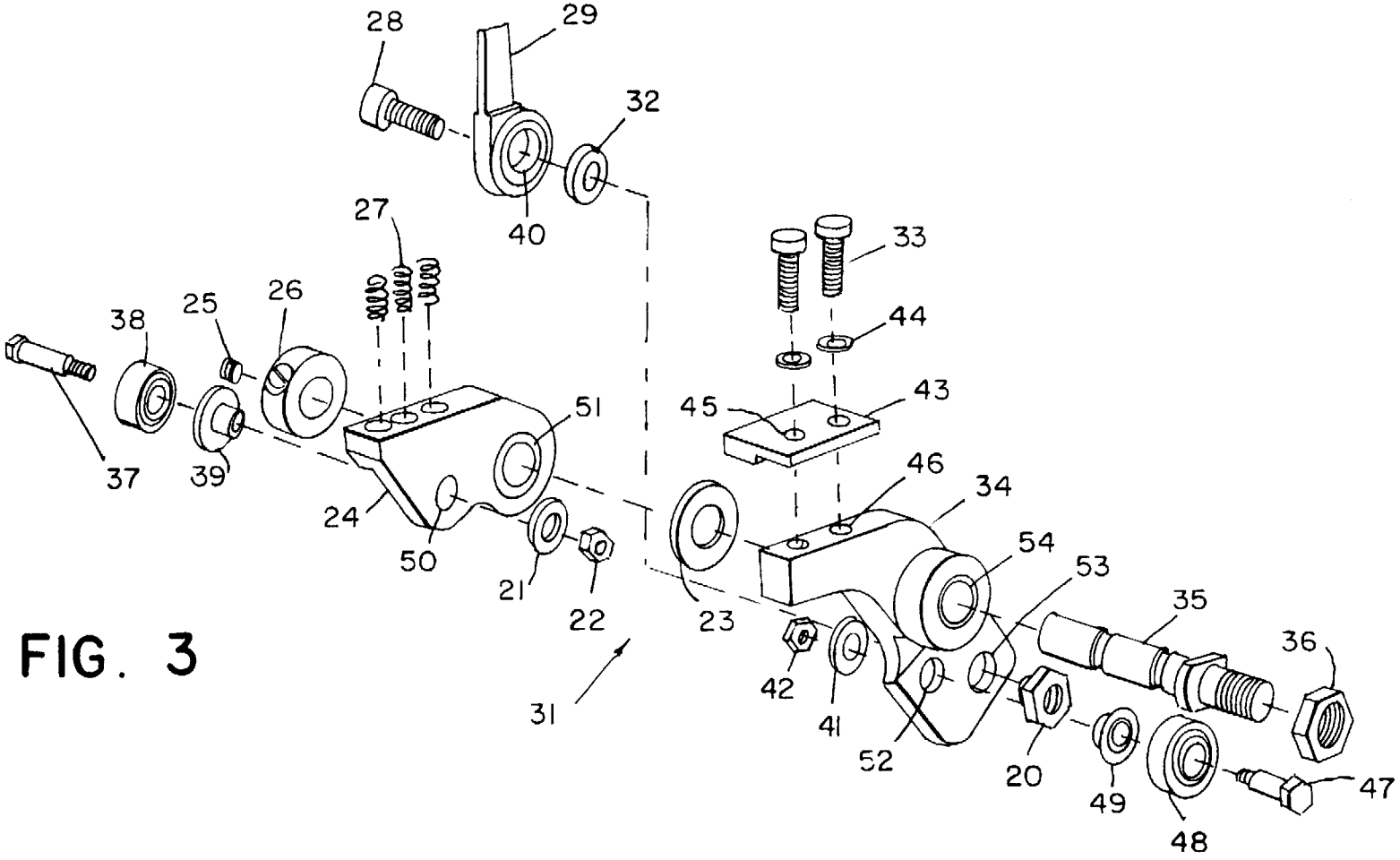
FIG. 3 is an exploded view of a looper cam follower.

FIG. 3 shows an exploded view of the looper cam follower 31. The looper cam follower 31 has a left looper cam follower plate 24 and a right looper cam follower plate 34. The left looper cam follower plate 24 and the right looper cam follower plate 34 rotate on a looper pivot shaft 35. A hex nut 36 is fastened on a threaded end of the looper pivot shaft 35. The looper pivot shaft 35 passes through a bearing 54 in the right looper cam follower plate 34, through a shoulder washer 23, through a bearing 51 in the left looper cam follower plate 24 and through a clamping collar 26. The clamping collar 26 is secured in position on the looper pivot shaft 35 by set screw 25.

The looper cam follower moves a looper arm assembly 29 which is attached to the right looper cam follower plate 34 by a screw 28 which passes through a bearing 40 in an end of the looper arm assembly 29, through a washer 32 and through an opening 53 in the right looper cam follower plate 34. The screw 28 is secured by looper eccentric nut 20.

A spring retainer block 43 is positioned on a top surface of the right looper cam follower plate 34. Twin screws 33 with twin lock washers 44 pass through twin holes 45 in the spring retainer block 43 and are secured in twin holes 46 in the top surface of the right looper cam follower plate 34. The spring retainer block 43 extends over a top surface of the left looper cam follower plate 24. Triple compression springs 27 extend from openings in a top of the left looper cam follower plate 24 and are positioned between the top surface of the left looper cam follower plate 24 and the spring retainer block 43 to urge the right and left looper cam follower plates in opposite directions so that the follower rollers maintain contact with outer surfaces of the double cam.

A first looper cam follower bearing roller 38 is mounted on the left looper cam follower plate 24 by a first looper feed follower bearing shoulder screw 37. The first looper feed follower bearing shoulder screw 37 passes through the first looper cam follower bearing roller 38, through a first bearing spacer 39, through an aperture 50 in the left looper cam follower plate 24 and through a first shoulder washer 21 and is fastened by a first nut 22. A second looper cam follower bearing roller 48 is positioned adjacent to the right looper cam follower plate 34 by a looper feed follower bearing shoulder screw 47. The looper feed follower bearing shoulder screw 47 passes through the looper cam follower bearing roller 48, through a bearing spacer 49, through an opening 52 in the right looper cam follower plate 34 and through a shoulder washer 41 and is fastened by a nut 42.

Figure 4A:
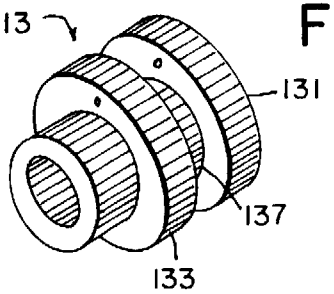
FIGS. 4A, 4B, and 4C are a perspective view, an end view and a cross-sectional side view respectively of the feed cam having two elliptically shaped concentric cams formed on a feed cam bushing.
Figure 4B:
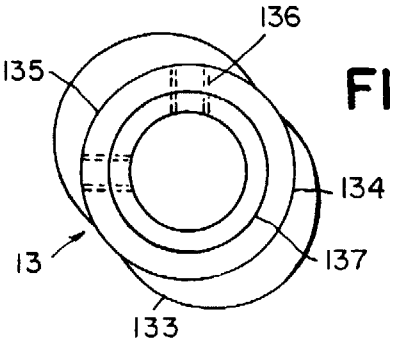
Figure 4C:
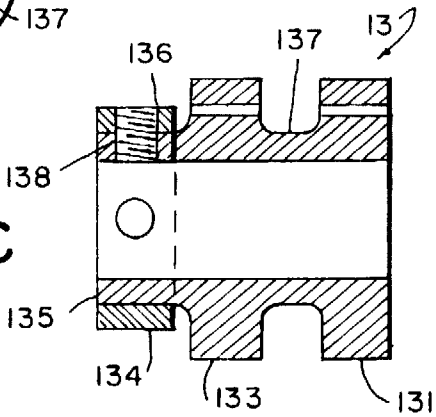

FIGS. 4A, 4B and 4C show a perspective view, an end view and a cross-sectional side view respectively of the feed double cam 13. The feed double cam 13 has first and second concentric cams 131, 133. Each cam has a generally elliptical shape. The first cam 131 of the feed double cam 13 is positioned at an end of the feed cam bushing section 137. The second cam 133 is positioned at a middle of the feed cam bushing section 137. As shown in FIG. 4B, the first cam 131 is aligned with the second cam 133. As shown in FIGS. 4B and 4C, a collar 134 surrounds an extended portion 135 of the bushing 137. Threaded openings 136 in the collar 134 and bushing 137 receive set screws 138 to fix the feed double cam 13 on the drive shaft 15.

Figure 5:
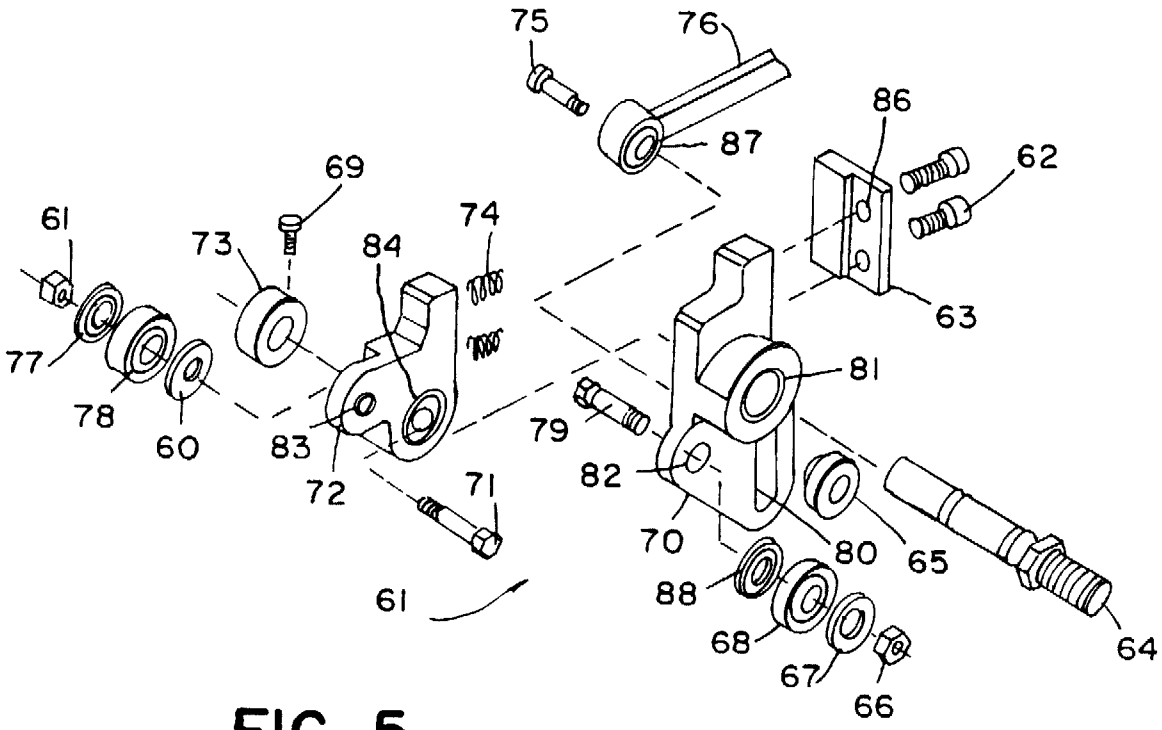
FIG. 5 is an exploded view of a feed cam follower.

FIG. 5 shows an exploded view of a feed cam follower 61. The feed cam follower 61 has a left feed cam follower plate 72 and a right feed cam follower plate 70. The left feed cam follower plate 72 and the right feed cam follower plate 70 rotate on a feed pivot shaft 64. The feed pivot shaft 64 passes through a bearing 81 in the right feed cam follower plate 70, through a bearing 84 in the left feed cam follower plate 72 and through clamping collar 73. The clamping collar 73 is secured in position by set screw 69.

The feed cam follower 61 moves a feed connecting link 76 which is attached to the right feed cam follower plate 70 by a shoulder screw 75 which passes through a bearing 87 in a distal end of the feed connecting link 76 and through an elongated slot 80 in the right feed cam follower plate 70. The shoulder screw 75 is secured by shoulder nut 65. Adjusting the position of the shoulder nut 65 and shoulder screw 75 in the slot 80 adjusts the stroke of the feed cam follower 61.

A spring retainer block 63 is positioned on a rear surface of the right feed cam follower plate 70. Twin screws 62 pass through holes 86 in the spring retainer block 63 and are secured in twin threaded holes in the rear surface of the right feed cam follower plate 70. The spring retainer block 63 extends over a rear surface of the left feed cam follower plate 72. Twin compression springs 74 are mounted in openings in the rear surface of the left feed cam follower plate 72 and are positioned between the rear surface of the left feed cam follower plate 72 and the spring retainer block 63 to urge the right and left feed cam follower plates in opposite directions for maintaining contact with the cam surfaces.

A first feed cam follower bearing roller 78 is mounted on the left feed cam follower plate 72 by a first feed follower bearing shoulder screw 71. The first feed follower bearing shoulder screw 71 passes through an aperture 83 in the left feed cam follower plate 72, through a shoulder washer 60, through the first feed cam follower bearing roller 78 and through a shoulder washer 77 and is fastened by a nut 61. A second feed cam follower bearing roller 68 is positioned adjacent to the right feed cam follower plate 70 by a second feed follower bearing shoulder screw 79. The second feed follower bearing shoulder screw 79 passes through an opening 82 in the right feed cam follower plate 70, through shoulder washer 88, through the second feed cam follower bearing roller 68 and through a shoulder washer 67 and is fastened by a nut 66.

Figure 6A:
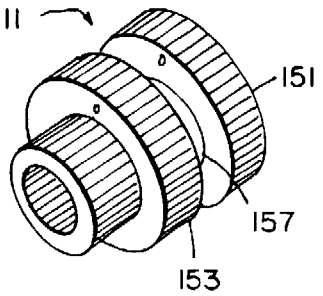
FIGS. 6A, 6B, and 6C are a perspective view, an end view and a cross-sectional side view respectively of the bite cam having two concentric cams formed on a bite cam bushing.
Figure 6B:
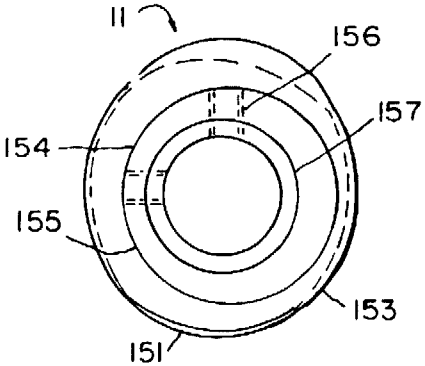
Figure 6C:
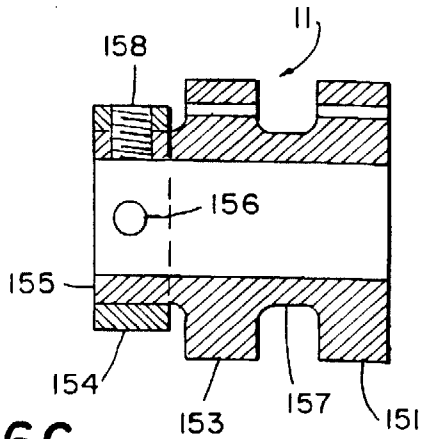

FIGS. 6A, 6B and 6C show a perspective view, an end view and a cross-sectional side view respectively of the bite double cam 11. The bite double cam 11 has a first and a second concentric cam 151, 153. The first cam 151 of the bite double cam 11 is positioned at an end of the bite cam bushing section 157. The second cam 153 is positioned at a middle of the bite cam bushing section 157. As shown in FIG. 6B, both the first and the second cams 151, 153 are eccentrically positioned on the feed cam bushing section 157. Each cam has a similar shape, and the first cam 151 is offset angularly from the second cam 153. As shown in FIGS. 6B and 6C, a collar 154 surrounds an extended portion 155 of the bushing 157. Threaded openings 156 in the collar 154 and bushing 157 receive set screws 158 to fix the bite double cam 11 on the drive shaft 15.

Figure 7:
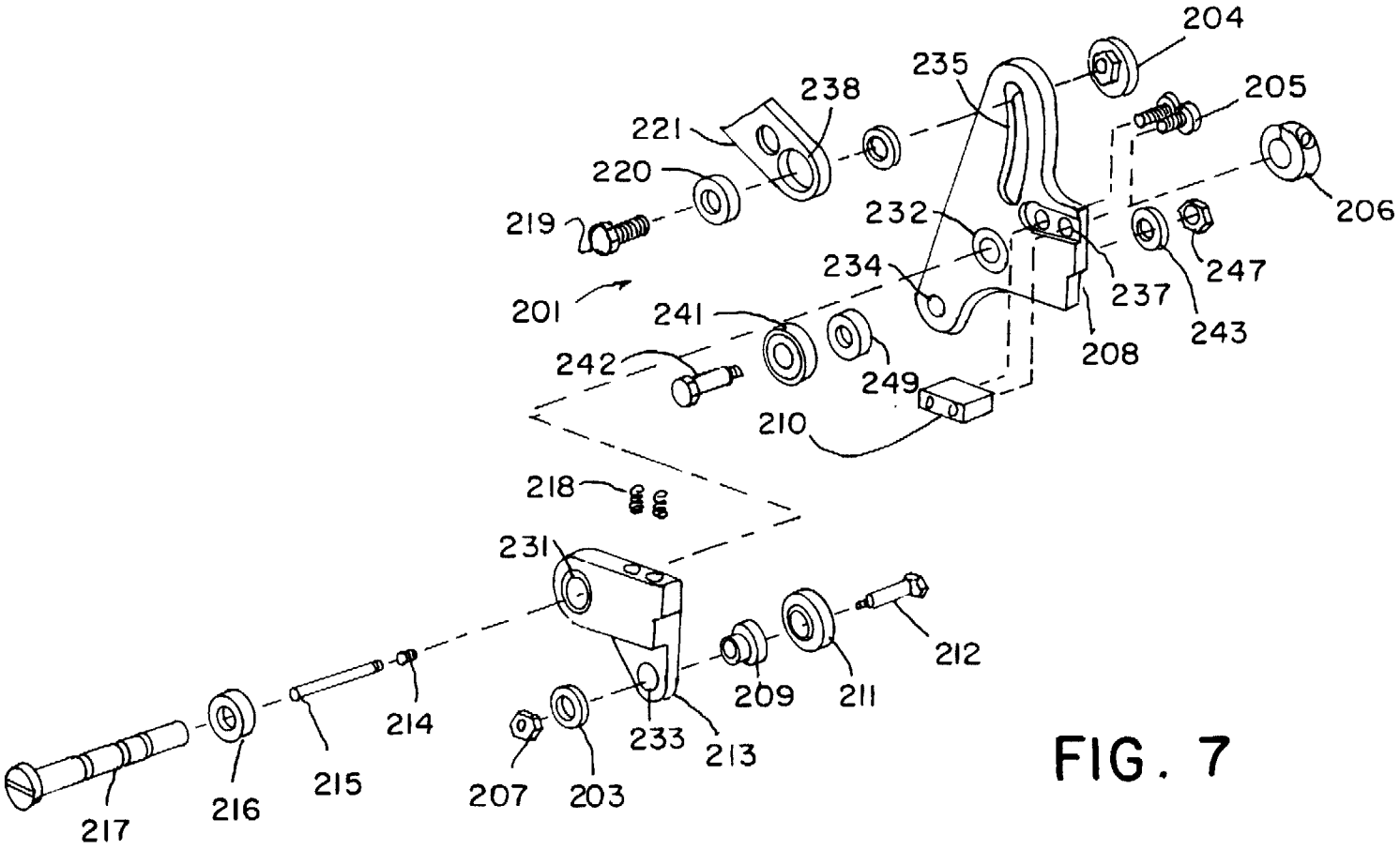
FIG. 7 is an exploded view of a bite cam follower.

FIG. 7 is an exploded view of the bite cam follower 201. The bite cam follower 201 has a left bite cam follower plate 213 and a right bite cam follower plate 208. The left bite cam follower plate 213 and the right bite cam follower plate 208 rotate on a bite pivot shaft 217. The bite pivot shaft 217 passes through a bearing 231 in the left bite cam follower plate 213 and through a bearing 232 in the right bite cam follower plate 208 and is secured in a screw clamping collar 206.

The bite cam follower 201 moves a bite adjusting link 221 which is attached to the right bite cam follower plate 208 by a bite shoulder screw 219 which passes through bearing 220, a hole 238 in a distal end of the bite adjusting link 221, a shoulder washer and a curved elliptical slot 235 in the right bite cam follower plate 208. The screw 219 is secured by shoulder nut 204. Adjusting the position of the shoulder nut 204 and the bite shoulder screw in the slot 235 adjusts the stroke of the bite cam follower 201.

A bite follower spring retainer 210 is positioned in a groove in a middle of a side surface of the right bite cam follower plate 208. Twin screws 205 pass through holes 237 in the right bite cam follower plate 208 and are secured in twin threaded holes in the bite follower spring retainer 210. The bite follower spring retainer 210 extends over a top surface of the left bite cam follower plate 213. Twin compression springs 218 are mounted in openings in the top surface of the left bite cam follower plate 213 and are positioned between the top surface of the left bite cam follower plate 213 and the bite follower spring retainer 210 to urge the right and left bite cam follower plates in opposite directions for maintaining contact between the cam follower rollers and the cam surfaces.

A first bite cam follower bearing roller 211 is mounted on the left bite cam follower plate 213 by a first bite follower bearing shoulder screw 212. The first bite follower bearing shoulder screw 212 passes through the first bite cam follower bearing roller 211, through a first bite follower bearing spacer 209, through an aperture 233 in the left bite cam follower plate 213 and through a shoulder washer 203 and is fastened by a hex nut 207. A second bite cam follower bearing roller 241 is mounted on the right bite cam follower plate 208 by a second bite follower bearing shoulder screw 242. The second bite follower bearing shoulder screw 242 passes through the second bite cam follower bearing roller 241, through the bite follower spacer 249, through an opening 234 in the right bite cam follower plate 208 and through a shoulder washer 243 and is fastened by a hex nut 247.

While the invention has been described with reference to specific embodiments, modifications and variations of the invention may be construed without departing from the scope of the invention, which is defined in the following claims.

We claim:

1. A double cam drive for use in a buttonhole sewing machine comprising a double looper cam and a double feed cam mounted on a main drive shaft, wherein the double looper cam comprises a looper cam bushing section and a double cam having a first concentric cam formed at an end of the looper cam bushing section and a second concentric cam formed at a middle of the looper cam bushing section, wherein the double feed cam comprises a feed cam bushing section and a double cam having a first concentric cam formed at an end of the feed cam bushing and a second concentric cam formed at a middle of the feed cam bushing section, a looper cam follower pivoted on a looper cam stub shaft and paired looper roller followers having a first roller contacting the first concentric cam of the looper cam and a second roller contacting the second concentric cam of the looper cam, wherein the first roller is positioned on an outside surface of the double looper cam opposite the second roller, a feed cam follower pivoted on a feed cam stub shaft and feed roller followers having a first feed cam follower roller contacting the first concentric cam of the feed cam and a second feed cam follower roller contacting the second concentric cam of the feed cam and wherein the first feed cam follower roller is positioned on an outer surface of the feed cam opposite the feed cam follower roller.

2. The apparatus of claim 1, wherein the followers are flat, wherein the rollers extend from opposite sides of the follower, and wherein the double cams and the paired roller followers provide positive motion of the followers in opposite rotational directions and provide continuous contact between the rollers and cam surfaces.

3. The apparatus of claim 1, wherein the followers comprise first and second follower plates mounted on the stub shafts wherein the first rollers are mounted on the first plates and the second rollers are mounted on the second plates, and wherein the plates are spring loaded for permitting rotational movement of the plates and urging the plates in differential rotation to maintain the rollers against the cams.

4. The apparatus of claim 3, further comprising spring retainer blocks extending from the first plates and springs mounted in the second plates and bearing against the extensions for urging the plates in differential rotation.

5. The apparatus of claim 1, wherein the first and second concentric cams of the double looper cam and the bushing section are made of a metal material, and are secured together and wherein the first and second concentric cams of the double feed cam and the feed cam bushings section are made of a metal material and are secured together.

6. The apparatus of claim 1, further comprising a bight cam connected to the main drive shaft, wherein the double bight cam is a bite cam bushing section and a double cam having a first concentric cam formed at an end of the bite cam bushing section and a second concentric cam formed at a middle of the bight cam bushing section, further comprising a bight cam follower pivoted on a bite stub shaft and having a first bite cam follower roller contacting the first concentric bite cam and a second bite cam follower roller contacting the second concentric bite cam and wherein the first roller is positioned on an outer surface of the double bite cam opposite the second roller.

7. The apparatus of claim 6, wherein the first and second concentric cams and the bushing of the bight cam are made of a metal material and are secured together.

8. The apparatus of claim 6, further comprising mounting collars positioned around axial bushing extensions of each double cam bushing and set screws extending through the collars and bushing extensions for securing the double cams to the main drive shaft.

9. The double cam drive of claim 6, wherein the looper cam operates a looper arm assembly, the feed cam drives a feed connecting link and the bite cam drives a bite adjusting link for deflecting a needle housing to make side stitches and tacks.

10. A double cam drive for a buttonhole sewing machine comprising a looper double cam, a feed double cam and a bite double cam mounted on a main drive shaft, a looper cam follower pivoted on a looper pivot shaft, a feed cam follower pivoted on a feed pivot shaft and a bite cam follower pivoted on a bite pivot shaft.

11. The double cam drive of claim 10, wherein the looper double cam further comprises a first concentric cam and a second concentric cam formed on a looper cam bushing section.

12. The double cam drive of claim 11, wherein the first concentric cam is mounted at an end of the looper cam bushing section and wherein the second concentric cam is mounted at a middle of the looper cam bushing section.

13. The double cam drive of claim 12, wherein the first concentric cam and the second concentric cam are eccentrically positioned on the looper cam bushing section.

14. The double cam drive of claim 13, wherein the first concentric cam is offset in such a manner that the maximum displacement of a lobe of the first concentric cam is oriented opposite the maximum displacement of a lobe of the second concentric cam.

15. The double cam drive of claim 10, wherein the feed double cam further comprises a first concentric cam and a second concentric cam formed on a feed cam bushing section.

16. The double cam drive of claim 15, wherein the first concentric cam is mounted at an end of the feed cam bushing section and wherein the second concentric cam is mounted at a middle of the feed cam bushing section.

17. The double cam drive of claim 16, wherein the first concentric cam and the second concentric cam are aligned on the feed cam bushing section.

18. The double cam drive of claim 10, wherein the bite double cam further comprises a first concentric cam and a second concentric cam formed on a bite cam bushing section.

19. The double cam drive of claim 18, wherein the first concentric cam is mounted at an end of the bite cam bushing section and wherein the second concentric cam is mounted at a middle of the bite cam bushing section.

20. The double cam drive of claim 19, wherein the first concentric cam and the second concentric cam are eccentrically positioned on the bite cam bushing section, each cam has a similar shape and the first cam is offset angularly from the second cam.

21. The double drive cam of claim 10, further comprising a looper cam mounting collar positioned around an extended portion of a looper cam bushing for securing the looper double cam to the main drive shaft, a feed cam mounting collar positioned around an extended portion of a feed cam bushing for securing the feed cam to the main drive shaft and a bite cam mounting collar positioned around an extended portion of a bite cam bushing for securing the bite cam to the main drive shaft and further comprising set screws extending through the mounting collars and bushing extensions for securing the double cams to the main drive shaft.

22. The double cam drive of claim 10, wherein the looper cam follower further comprises a left looper cam follower plate and a right looper cam follower plate and wherein a first looper cam follower bearing roller is mounted on the left looper cam follower plate and a second looper cam follower bearing roller is mounted on the right looper cam follower plate.

23. The double cam drive of claim 22, wherein the left and right looper cam follower plates are flat and are aligned on the looper pivot shaft, wherein the rollers extend from opposite sides of the follower and wherein the looper double cam and the paired rollers provide positive motion of the looper cam follower in opposite rotational directions and provide continuous contact between the rollers and outer cam looper surfaces.

24. The double cam drive of claim 23, further comprising a looper spring retainer block positioned on a top surface of the right looper cam follower plate and further comprising springs positioned between the looper spring retainer block and a top surface of the left looper cam follower plate for urging the right and left looper cam follower plates in opposite directions so that the paired rollers maintain contact with the outer looper cam surfaces.

25. The double cam drive of claim 10, wherein the feed cam follower further comprises a left feed cam follower plate and a right feed cam follower plate and wherein a first feed cam follower bearing roller is mounted on the left feed cam follower plate and a second feed cam follower bearing roller is mounted on the right feed cam follower plate.

26. The double cam drive of claim 25, wherein the left and right feed cam follower plates are flat and are aligned on the feed pivot shaft, wherein the rollers extend from opposite sides of the follower and wherein the feed double cam and the paired rollers provide positive motion of the feed cam follower in opposite rotational directions and provide continuous contact between the rollers and outer feed cam surfaces.

27. The double cam drive of claim 26, further comprising a feed spring retainer block positioned on a top surface of the right feed cam follower plate and further comprising springs positioned between the feed spring retainer block and a top surface of the left feed cam follower plate for urging the right and left feed cam follower plates in opposite directions so that the paired rollers maintain contact with the outer feed cam surfaces.

28. The double cam drive of claim 10, wherein the bite cam follower further comprises a left bite cam follower plate and a right bite cam follower plate and wherein a first bite cam follower bearing roller is mounted on the left bite cam follower plate and a second bite cam follower bearing roller is mounted on the right bite cam follower plate.

29. The double cam drive of claim 28, wherein the left and right bite cam follower plates are flat and are aligned on the bite pivot shaft, wherein the rollers extend from opposite sides of the follower and wherein the bite double cam and the paired rollers provide positive motion of the bite cam follower in opposite rotational directions and provide continuous contact between the rollers and outer bite cam surfaces.

30. The double cam drive of claim 29, further comprising a bite spring retainer block positioned on a top surface of the right bite cam follower plate and further comprising springs positioned between the bite spring retainer block and a top surface of the left bite cam follower plate for urging the right and left bite cam follower plates in opposite directions so that the paired rollers maintain contact with the outer bite cam surfaces.

31. The apparatus of claim 10, wherein the first and second concentric cams of the looper cam have an oblong-shape, wherein the first and second concentric cams of the feed cam have a generally elliptical shape and wherein the first and second concentric cams of the bite cam have a generally circular shape.

32. The double cam drive of claim 10, wherein the looper cam, the feed cam and the bite cam are made of plastic.

33. The double cam drive of claim 10, wherein the looper cam operates a looper arm assembly, the feed cam drives a feed connecting link and the bite cam drives a bite adjusting link for deflecting a needle housing to make side stitches and tacks.

* * * * *